United States Patent [19]

Olivieri

[11] Patent Number: 4,574,499

[45] Date of Patent: Mar. 11, 1986

[54] FASTENING AND LOCKING DEVICE STRUCTURE, PARTICULARLY FOR SKI BOOTS

[75] Inventor: Icaro Olivieri, Westmount, Canada

[73] Assignee: Gaber Italia S.p.A., Montebelluna, Italy

[21] Appl. No.: 562,617

[22] Filed: Dec. 19, 1983

[30] Foreign Application Priority Data

Feb. 16, 1983 [IT] Italy ..... 30633/83[U]

[51] Int. Cl.[4] ..... A43B 5/04

[52] U.S. Cl. ..... 36/117; 36/120

[58] Field of Search ..... 36/117, 118, 119, 120, 36/121, 50

[56] References Cited

U.S. PATENT DOCUMENTS 4,190,970 3/1980 Annovi ..... 36/117 X 4,408,403 10/1983 Martin ..... 36/117 X 4,449,274 5/1984 Balbinot ..... 36/117 X

FOREIGN PATENT DOCUMENTS 3219772 1/1983 Fed. Rep. of Germany ..... 36/120

*Primary Examiner*—Louis K. Rimrodt

*Attorney, Agent, or Firm*—Guido Modiano; Albert Josif

[57] ABSTRACT

A fastening and locking device structure, particularly for ski boots, comprises a hollow frusto-conical element enclosing the ski boot shell at a middle region thereof. The frusto-conical element extends at a top region into a tongue and laterally to the ski boot into two wings encircling the ski boot middle region and joining together in a groove provided between the sole and the heel region of the ski boot. The frusto-conical element is further fixedly connected with two lugs extending towards the boot heel, whereat they present a tension lever device for fastening them together and tightening the boot flaps.

8 Claims, 3 Drawing Figures

FASTENING AND LOCKING DEVICE STRUCTURE, PARTICULARLY FOR SKI BOOTS

BACKGROUND OF THE INVENTION

This invention relates to a fastening and locking device structure, particularly for ski boots.

It is usual practice to provide a plurality of levers acting between the boot upper flaps and quarter for fastening a ski boot on after the foot has been inserted in the boot.

Such levers have to be provided in a suitable number and appropriately distributed to produce an even tightening of the upper flaps, and may be obtrusive, inconvenient to adjust, and cause hindrance on account of their protruding from the structure.

SUMMARY OF THE INVENTION

It is an object of this invention to provide a structure with a fastening device which allows the foot to be blocked evenly especially around the instep and toe regions.

Another object is that of providing a structure which has no linkages located at the upper front and top portions.

It is a further object of the invention to provide a fastening device having a reduced number of levers located at areas of no hindrance.

A not unimportant object is to provide a fastening device structure which is practical and reliable.

These and other objects, such as will be apparent hereinafter, are achieved by a fastening and locking device structure, particularly for ski boots, characterized in that it comprises a hollow frusto-conical element enclosing the ski boot upper at the middle region of the latter and being extended at the top into a tongue, two lugs being associated with said element which are completed at the heel region by the provision of a tension lever device effective to be tightened on the foot instep by pulling the frusto-conical element toward the heel.

BRIEF DESCRIPTION OF THE DRAWINGS

Further features and advantages of the invention will be more clearly understood from the following detailed description of a preferred embodiment thereof, given herein by way of illustration only with reference to the accompanying drawings, where.

DESCRIPTION OF THE PREFERRED EMBODIMENTS

Figure 2:
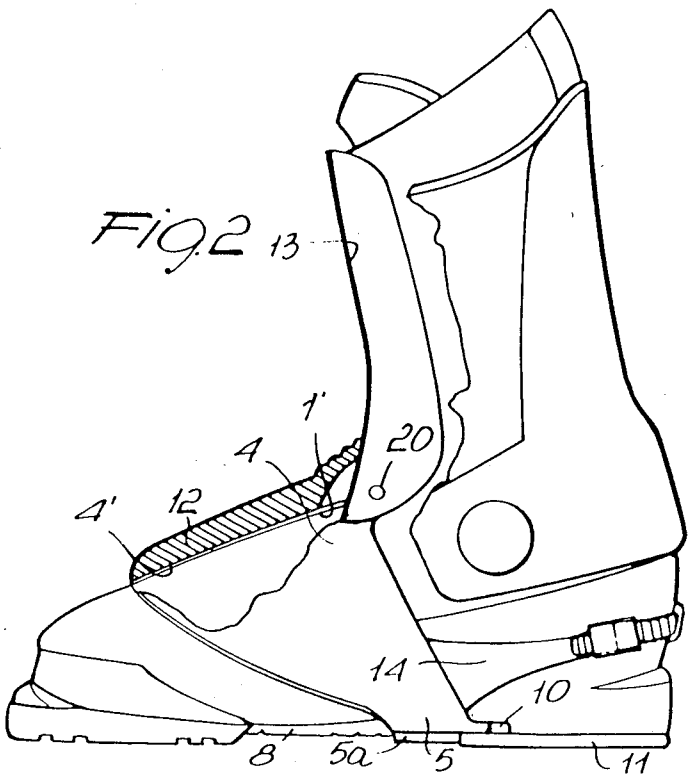
FIG. 2 shows the ski boot of FIG. 1 as partly sectioned to illustrate the frusto-conical element whereby fastening is accomplished.
Figure 1:
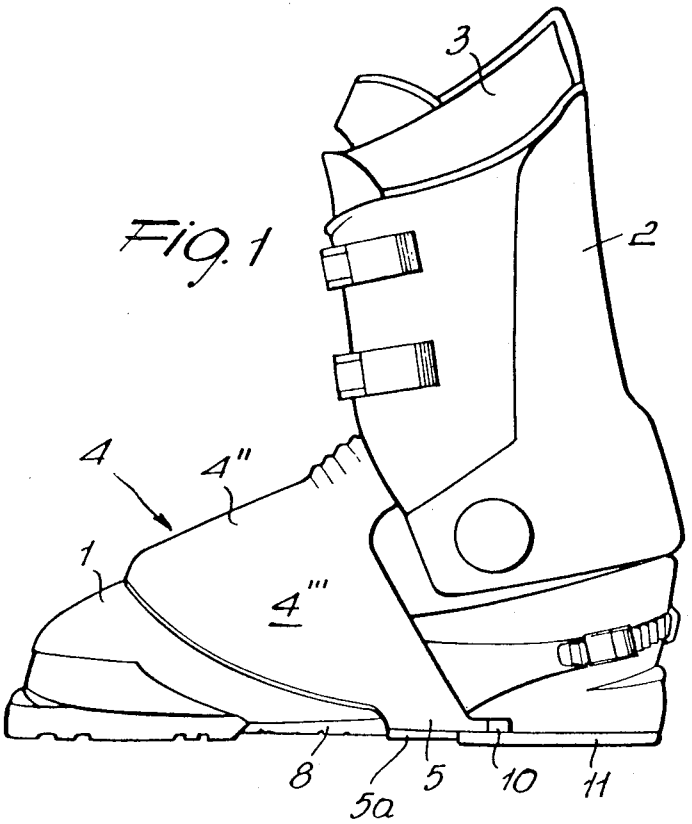
FIG. 1 is a side elevation view of a ski boot incorporating a structure according to the invention.

With reference to the drawing views, on a ski boot comprising essentially a shell 1, quarter 2, and inner shoe 3, there is mounted a frusto-conical arcuated element 4 which encloses the upper at the instep or foot middle region 1' and which has an inner surface 4' at least partially of frusto-conical shape slidably embracing the instep portion 1' of the ski boot.

Such frusto-conical element which is obtained by molding of plastics materials, a top portion 4'', side portions 4''' and two wings of flaps 5 and 6 which end underneath the sole 8 with thickened or reinforced end portions 5*a* and 6*a* forming together a sort of block. The end portions 5*a* and 6*a* are joined to each other by means of adjustment screws 7 which enable the width of the frusto-conical element to be adjusted.

Said block, formed by the union of 5*a* and 6*a* together, is located under the sole 8 of the boot and inserted into a groove 10 formed in the heel 11 of the boot.

Said frusto-conical element has a thick middle rib formation 12 located above the foot instep and is extended into a large tongue 13 which is encircled by the front portion of the quarter.

The tongue may comprise an element hinged at 20 on the frusto-conical element.

The frusto-conical element 4 further includes two flat lateral lugs, indicated at 14 and 15 respectively, which extend from the side portions 4 toward the boot heel.

At this region, the lug 15 has a tension lever 16 pivoted to a mount 17 made rigid with the lug 15 as by riveting.

Provided on the lever 16 and pivoted at 22 eccentrically to the pivot center 21 of the lever itself is a serrated strip 18 which engages with an adjustable anchoring element 19 rigid with the lug 14.

Figure 3:
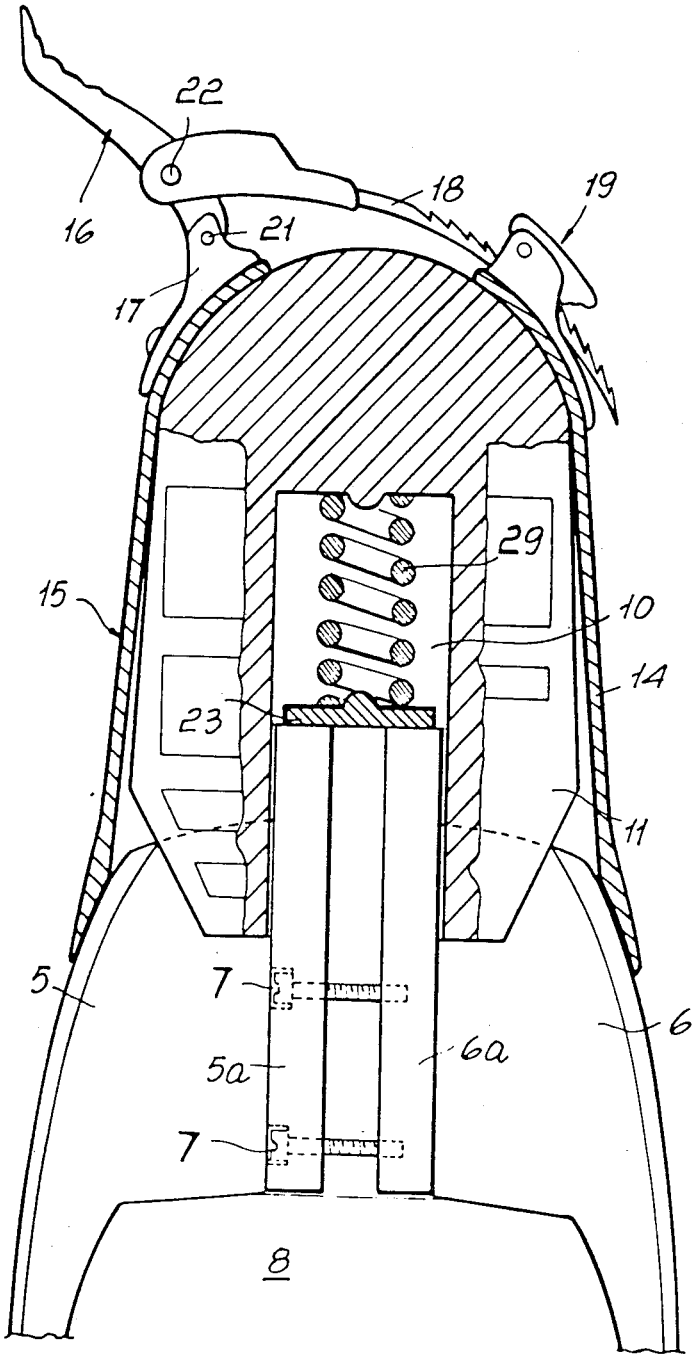
FIG. 3 is a partly sectional bottom view of the ski boot, showing the fastening lever devices.

As may be seen more clearly in FIG. 3, by inserting the strip 18 in the anchoring element 19 and adjusting the position of the strip 18, and then acting on the lever 16, the device is fastened with the lugs 14 and 15 being pulled toward the boot heel.

Thus, the frusto-conical element 4 is caused to slide or move to the rear to affect a gradually increasing section of the boot, and the boot flaps are tightened with a pressure which is spread across the entire top portion of the shell 1.

A spring 29, contained within the heel 11, is compressed as the lever 16 is placed under tension thereby antagonizing the pulling action thereof, and, by pushing a plate 23 abutting against the thickened portions 5*a*, 6*a* of the wings, moves the frusto-conical element 4 forward as the lever 16 is released, thus facilitating the opening of the ski boot.

In practice, by acting on a single adjustable fastening element, one can firmly lock the foot inside the shell with a pressure which is uniformly distributed across the entire top region of the shell.

The swelling brought about by the top rib formation 12 allows the tension force exerted at the rear to be discharged without undergoing any appreciable deformation of the frusto-conical element.

It may be noted that the shell as completed with the frusto-conical element no longer shows any protruding parts formed, as is usual, by linkages or other devices.

The closure pressure is adjustable by acting on the adjustments of the single rear fastening arrangement, while the quarter will be conveniently provided with other independent closure devices.

The rear lever fastening device, which has been described in the foregoing with reference to a particular configuration thereof, may apparently be any suitable one to apply a pull toward the boot rear to the lugs 14 and 15 which are associated with the frusto-conical element, which generates and distributes the closure pressure over the boot shell.

The lugs 14 and 15 may be formed from the same material from which the frusto-conical element 4 is formed, but may be of another material connected in any suitable manner to the element.

For this reason, the materials and dimensions may be any ones depending on requirements.

I claim:

1. A fastening and locking device structure particularly for ski boots comprising a hollow frusto-conical element enclosing a ski boot shell at a middle region thereof and being extended at a top region into a tongue, lugs fixedly connected with said frusto-conical element and having, at a heel region of a ski boot, a tension lever device, said hollow frusto-conical element defining lower wings extending under a boot sole, a width regulating device for said frusto-conical element connecting to each other said wings, said frusto-conical element being movable on said ski boot shell, said tension lever device being adapted to move said hollow frusto-conical element on said ski boot shell, towards said heel region of said ski boot, for fastening said ski boot and simultaneously exerting pressure on a foot instep.

2. A structure according to claim 1 wherein said hollow frusto-conical element is defined by said two wings and a reinforcing top middle rib formation, said reinforcing top middle rib formation being adapted for preventing deformation of said hollow frusto conical element, at a region where it compresses shell flaps to be closed together, said wings being adapted for encircling said ski boot shell at said middle region thereof from said top region.

3. A structure according to claim 1 wherein said hollow frusto-conical element defines at least said two wings, said at least two wings being adapted to be brought together under a ski boot sole for sliding engagement with a longitudinal groove, said longitudinal groove being provided between a sole region and a heel region of said ski boot.

4. A structure according to claim 3 wherein said at least two wings are interconnected by adjustment screws operative for adjusting a closure force exerted by said hollow frusto-conical element on said ski boot shell, in conjunction with said tension lever device.

5. A structure according to claim 1 wherein said lugs, extend from said hollow frusto-conical element to said heel region of said ski boot and include a mutual engagement closure means at the ends thereof.

6. A structure according to claim 1 further comprising spring means, said spring means being arranged in said heel portion of said ski boot and effective to bias said hollow frusto-conical element away therefrom, said tension lever device being operable to move said hollow frusto-conical element towards said heel region against an elastic biasing force generated by said spring means.

7. A fastening and locking device structure particularly for ski boots comprising an arcuated element having at least internally a surface at least partially of frusto-conical shape arranged to slidably embrace an instep portion of a ski boot said arcuated element having a top arcuated portion and side portions extending from said top portion towards a sole portion of the ski boot, a pair of flap portions extending from said side portion underneath said sole portion, said flap portions having mutually facing reinforced free end formations connected to each other underneath said sole portion a pair of lugs extending from said side portions towards a heel region of said ski boot at both sides of said arcuated element, a tensioning device at the heel region of the ski boot and connected with said pair of lugs to selectively tension said lugs and thereby pull said arcuated element towards said heel region.

8. A fastening and locking device structure particularly for ski boots comprising an arcuated element having at least internally a surface at least partially of frusto-conical shape arranged to slidably embrance an instep portion of a ski boot shell, said arcuated element having a top arcuated portion and side portions extending from said top portion towards a sole portion of the ski boot, a pair of flap portions extending from said side portion underneath said sole portion, said flap portions having mutually facing reinforced free end formations underneath said sole portion and adjustable fastening means for adjustably connecting said reinforced free end formations to thereby adjust the width of said arcuated element, a pair of lugs extending from said side portions towards a heel region of said ski boot at both sides of said arcuated element, a tensioning device at the heel region of the ski boot and connected with said pair of lugs to selectively tension said lugs and thereby pull said arcuated element towards said heel region and spring means between said reinforced free end formations and a heel portion of said ski boot to antagonize the pulling action of said tensioning device on said arcuated element.

* * * * *